US011406192B1

(12) United States Patent
Wu

(10) Patent No.: US 11,406,192 B1
(45) Date of Patent: Aug. 9, 2022

(54) DETACHABLE SOFA

(71) Applicant: GENOVA INC., Diamond Bar, CA (US)

(72) Inventor: Peng Wu, Shanghai (CN)

(73) Assignee: GENOVA INC.

( * ) Notice: Subject to any disclaimer, the term of this patent is extended or adjusted under 35 U.S.C. 154(b) by 0 days.

(21) Appl. No.: 17/723,070

(22) Filed: Apr. 18, 2022

(30) Foreign Application Priority Data

Jan. 27, 2022 (CN) ..... 202220250839.0

(51) Int. Cl.

| | |
|---|---|
| ***A47C 4/02*** | (2006.01) |
| ***A47C 7/42*** | (2006.01) |
| ***A47C 13/00*** | (2006.01) |
| ***A47C 7/54*** | (2006.01) |
| ***A47C 17/02*** | (2006.01) |

(52) U.S. Cl.
CPC ..... *A47C 4/02* (2013.01); *A47C 4/028* (2013.01); *A47C 7/42* (2013.01); *A47C 7/546* (2013.01); *A47C 13/005* (2013.01); *A47C 17/02* (2013.01)

(58) Field of Classification Search
CPC .. A47C 4/028; A47C 4/02; A47C 7/42; A47C 7/546; A47C 13/005; A47C 17/02
USPC ... 297/218.5, 411.26, 411.27, 440.1, 440.14, 297/440.15, 440.16, 440.23
See application file for complete search history.

(56) References Cited

U.S. PATENT DOCUMENTS

| | | | | |
|---|---|---|---|---|
| 3,973,800 | A * | 8/1976 | Kogan | A47C 13/005 297/135 |
| 5,265,939 | A * | 11/1993 | Self | A47C 13/005 297/440.13 |
| 6,241,317 | B1 * | 6/2001 | Wu | A47C 4/02 297/440.1 |
| 7,140,690 | B2 * | 11/2006 | White | A47C 4/03 297/440.14 |
| 8,974,139 | B2 * | 3/2015 | Saul | A47C 4/02 297/440.1 |
| 2004/0095000 | A1 * | 5/2004 | Durling | A47C 13/005 297/188.2 |
| 2004/0155509 | A1 * | 8/2004 | Smith, Jr. | A47C 7/42 297/440.15 |
| 2005/0138884 | A1 * | 6/2005 | White | A47C 4/02 52/633 |
| 2005/0179303 | A1 * | 8/2005 | Owens | A47C 7/42 297/440.1 |

(Continued)

FOREIGN PATENT DOCUMENTS

EP 1106112 A1 * 6/2001 ..... A47C 13/005

*Primary Examiner* — Robert Canfield

(57) ABSTRACT

The invention disclosure relates to a detachable sofa comprising a backrest, a seat, two armrests and a chassis, wherein the backrest comprises a backrest body and left and right side wings, and the left and right side wings are detachably connected to the backrest body; each armrest includes an armrest pad and an armrest frame, and the armrests are detachably connected to the seat. The backrest body and the left and right side wings are connected by locking slots, and the armrest and the seat are connected by locking slots. In the detachable sofa of the invention disclosure, the backrest and the armrest can be further disassembled into smaller components, which can occupy smaller space and volume during storage and transportation, thus greatly reduce storage and transportation costs.

6 Claims, 6 Drawing Sheets

(56) References Cited

U.S. PATENT DOCUMENTS

| | | | | |
|---|---|---|---|---|
| 2016/0249742 | A1* | 9/2016 | Xie | A47C 4/028<br>297/440.23 |
| 2020/0100592 | A1* | 4/2020 | Policicchio | A47C 17/02 |
| 2020/0196751 | A1* | 6/2020 | Wong | A47B 85/04 |
| 2020/0375362 | A1* | 12/2020 | Hale | A47C 17/04 |
| 2021/0068547 | A1* | 3/2021 | Hodgson | A47C 7/42 |
| 2021/0274942 | A1* | 9/2021 | Ha | A47C 17/02 |
| 2022/0104622 | A1* | 4/2022 | Chen | A47C 7/546 |
| 2022/0104623 | A1* | 4/2022 | Bridgman | A47C 4/02 |

* cited by examiner

DETACHABLE SOFA

CROSS REFERENCE TO RELATED APPLICATIONS

This patent application claims the benefit of Chinese Patent Application No. 202220250839.0, filed Jan. 27, 2022, of which the above applications is incorporated by reference herein.

TECHNICAL FIELD

The invention disclosure relates to a sofa structure, in particular, to a detachable sofa.

BACKGROUND

At present, sofas are generally equipped with soft packaging portion due to the demand for comfort, so they are relatively big and occupy a large volume during storage and transportation, resulting in an increase in costs.

SUMMARY

In order to overcome the shortcomings of the prior art, the invention disclosure provides a detachable sofa. In order to solve the above-mentioned technical problems, the invention disclosure provides the following technical solutions:

A detachable sofa comprises a backrest, a seat, two armrests and a chassis, the backrest comprises a backrest body and left and right side wings, the left and right side wings are detachably connected to the backrest body; each armrest includes an armrest pad and an armrest frame, and both armrests are detachably connected to the seat.

The backrest body, the left and right side wings may be connected by locking slots, and the armrests and the seat are connected by locking slots.

The two sides of the backrest body may be provided with first locking slots, the left and right side wings are provided with second locking slots, the cross-section of the locking slot is basically U-shaped, and the width of the locking slot gradually increases from one end to the other end, and the width of the first locking slots on both sides of the backrest body is generally slightly larger than that of the second slots of the left and right side wings.

The first locking slots may be disposed on both sides of the seat, and second locking slots are disposed on the left and right armrests. The cross-section of the locking slot is basically U-shaped, and the width of the locking slot gradually increases from one end to the other end, and the width of the first locking slots on both sides of the seat is generally slightly larger than that of the second slots of the left and right armrests.

The armrest frames of the armrests, the backrest body and the left and right side wings may be all composed of support frames and the flexible packaging materials covering the support frames. The support frames may be threadedly connected by a plurality of tubular members.

The first locking slots and the second locking slots may be threadedly fixed on the support frames.

In the detachable sofa of the invention disclosure, the backrest and the armrests can be further disassembled into smaller components, which can occupy smaller space and volume during storage and transportation, and greatly reduce storage and transportation costs.

DESCRIPTION OF THE DRAWINGS

The present invention disclosure will be described in detail below with reference to the drawings and specific embodiments.

DETAILED EMBODIMENTS

The embodiments of the invention disclosure will be described below with reference to the drawings in the embodiments. It should be noted that the embodiments involved in the specification are not exhaustive and do not represent the only embodiments of the invention disclosure. The following corresponding embodiments are only for the purpose of clearly illustrating the invention disclosure content of the present invention disclosure patent, and are not intended to limit the embodiments thereof. For those of ordinary skill in the art, changes and modifications in different forms can also be made on the basis of the description of the embodiments. Any obvious changes or modifications that belong to the technical concept and content of the present invention disclosure are within the scope of protection of the invention disclosure.

Example

Figure 1:
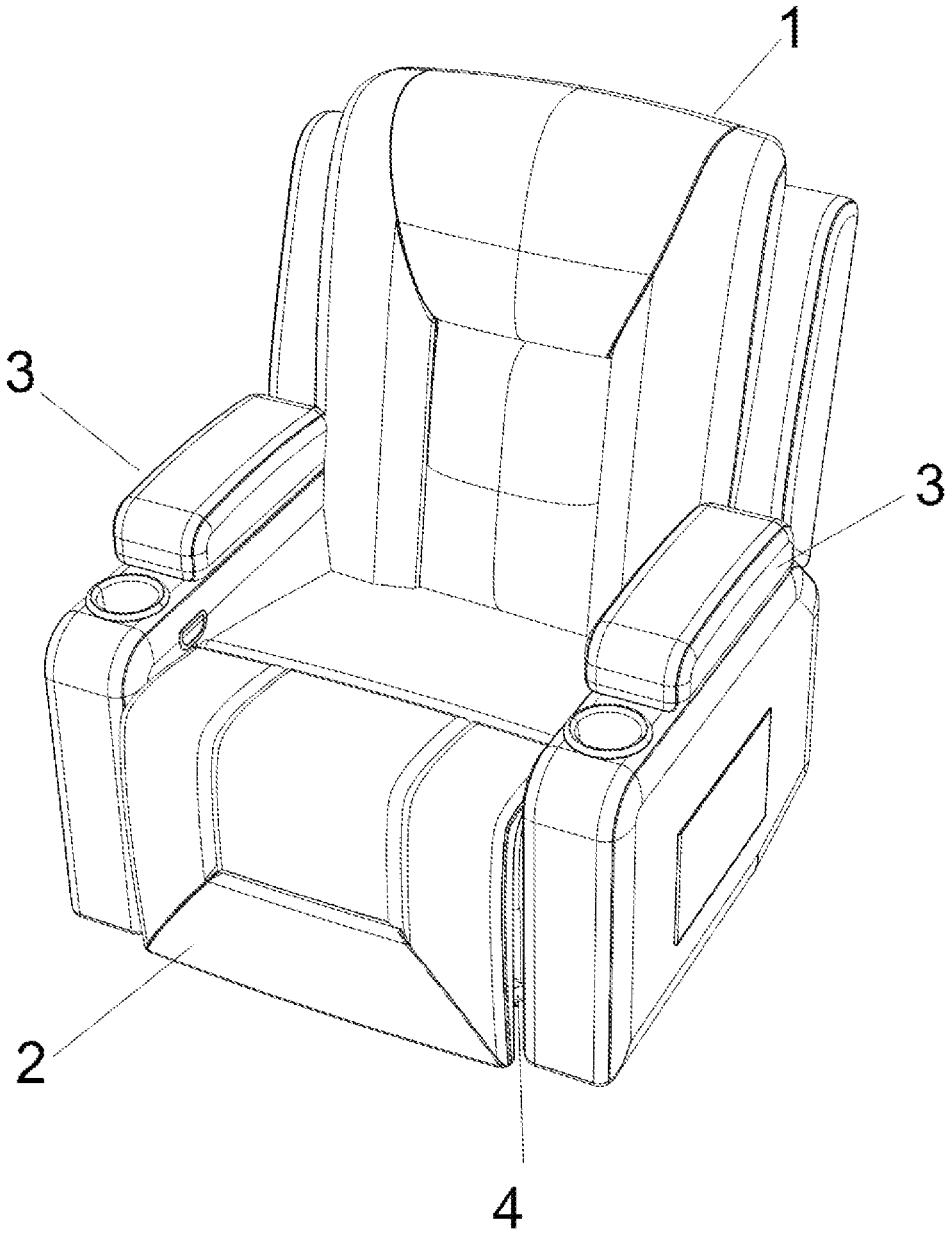
FIG. 1 is a stereogram of the detachable sofa of the invention disclosure.

FIG. 1 is a stereogram of the detachable sofa of the invention disclosure. As shown in FIG. 1, a detachable sofa of the invention disclosure includes a backrest 1, a seat 2, two armrests 3 and a chassis 4. The backrest 1 and the seat 2 are fixedly connected by insertion. Armrests 3 are fixedly disposed on both sides of the seat 2. A chassis 4 is disposed under the seat 2 to support the sofa.

Figure 2:
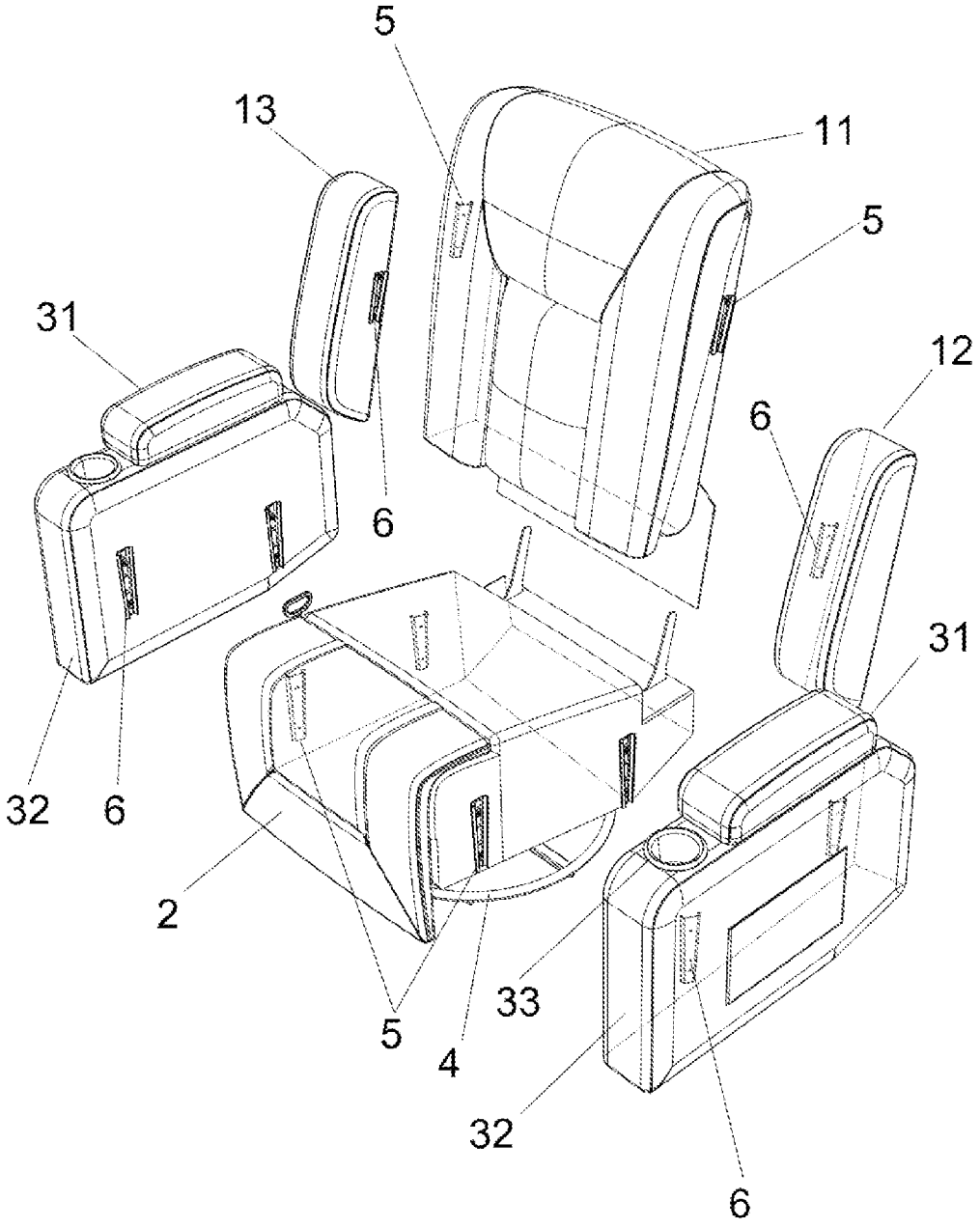
FIG. 2 is an exploded schematic view of the detachable sofa of the invention disclosure.
Figure 3:
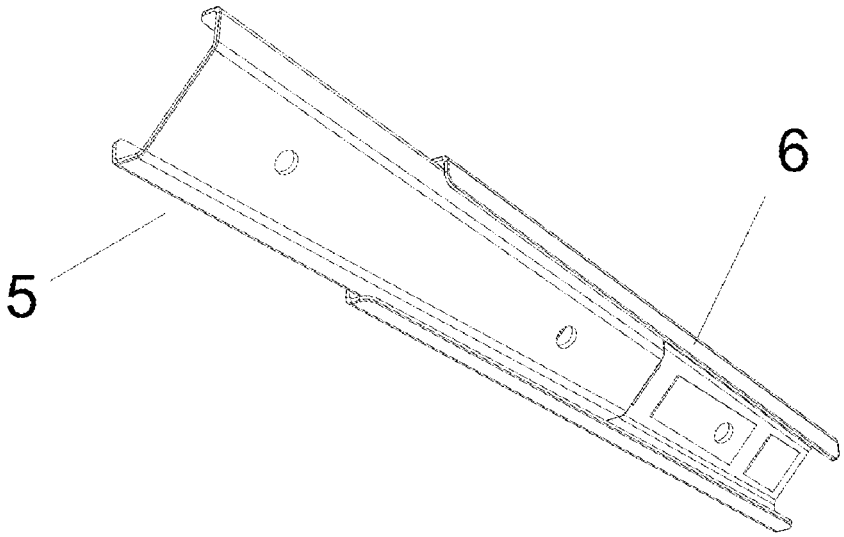
FIG. 3 is a schematic diagram of the structure of the locking slot of the detachable sofa of the invention disclosure.

FIG. 2 is an exploded schematic view of the detachable sofa of the invention disclosure. FIG. 3 is a schematic diagram of the connection structure of the locking slot of the detachable sofa of the invention disclosure. As shown in FIG. 2, the backrest 1 includes a backrest body 11 and left and right side wings 12 and 13. The left and right side wings 12 and 13 are detachably connected to the backrest body 11. Each armrest 3 includes an armrest pad 31 and an armrest frame 32, and the armrest frames 32 are detachably connected to both sides of the seat 2. Each armrest frame 32 also has a cup holder 33 for placing water cups and the like.

FIGS. 2-3 again, the backrest body 11 and the left and right side wings 12 and 13 are connected through the first locking slots 5 and the second locking slots 6, and the armrests 3 and the seat 2 are connected through the first locking slots 5 and the second locking slots 6.

The backrest body 11 is provided with the first locking slots 5 on both sides, and the left and right side wings 12 and 13 are provided with the second locking slots 6. The cross-section of the first locking slots 5 and the second locking slots 6 is basically U-shaped, the width of the locking slot gradually increases from one end to the other end (the upper part is larger and the lower part is smaller during installation), and the width of the first locking slots 5 on both sides of the backrest body 11 are generally slightly larger than that of the second locking slots 6 of the left and right side wings 12 and 13. Through the arrangement of the above-mentioned locking slots, the second locking slots 6 of the left and right side wings 12 and 13 can be inserted into the first locking slots 5 on both sides of the backrest body 11, and since the maximum width of the second locking slots 6 is larger than the minimum width of the first locking slots 5, the left and right side wings 12 and 13 can be locked, so that the left and right side wings 12 and 13 can be fixedly connected to the backrest body 11. When it needs to be disassembled, simply lift up the left and right side wings 12 and 13 along the direction of the locking slot.

Both sides of the seat 2 are provided with the first locking slots 5, and the left and right armrests 3 are provided with the second locking slots 6. The cross-section of the first locking slots 5 and the second locking slots 6 is basically U-shaped. The free end of the U shape may be also bent inward at a certain angle. The width of the locking slot gradually increases from one end to the other end (the upper part is larger and the lower part is smaller during installation), and the width of the first locking slots 5 on both sides of the seat 2 is generally slightly larger than that of the second locking slots 6 of the left and right armrests 3. Through the arrangement of the above-mentioned locking slots, the second locking slots 6 of the left and right armrests 3 can be inserted into the first locking slots 5 on both sides of the seat 2, and since the maximum width of the second locking slots 6 is larger than the minimum width of the first locking slots 5, the left and right armrests 3 can be locked, so that the left and right armrests 3 can be fixedly connected with the seat 2. When it needs to be disassembled, simply lift the left and right armrests 3 up along the direction of the locking slot.

Figure 4:
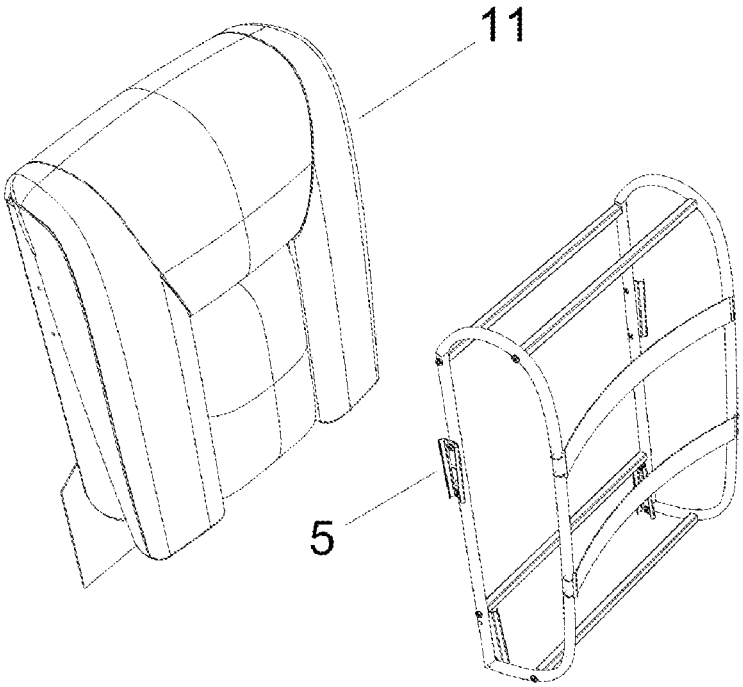
FIG. 4 is a schematic diagram of the structure of the backrest body of the detachable sofa of the invention disclosure.
Figure 5:
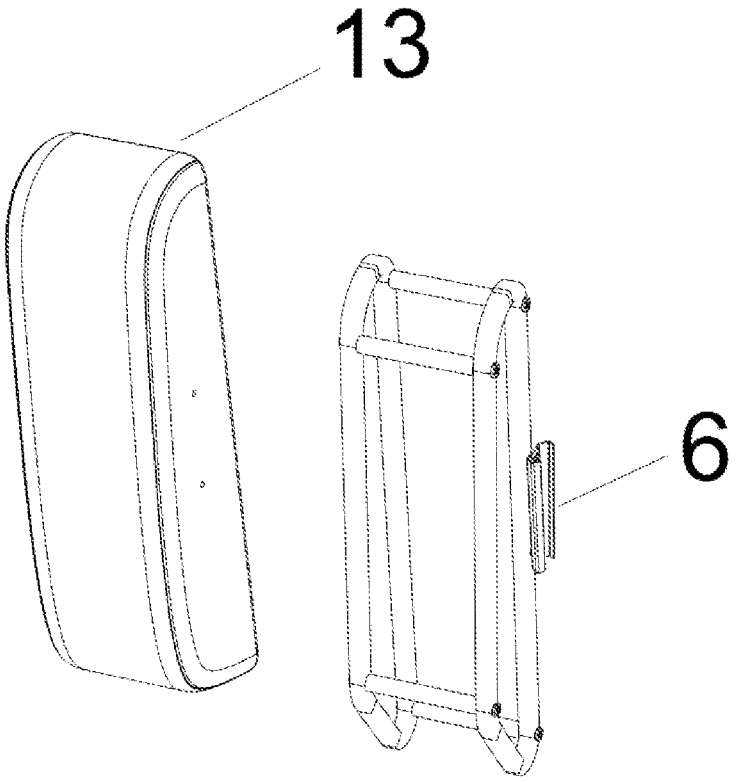
FIG. 5 is a schematic diagram of the structure of the backrest side wing of the detachable sofa of the invention disclosure.
Figure 6:
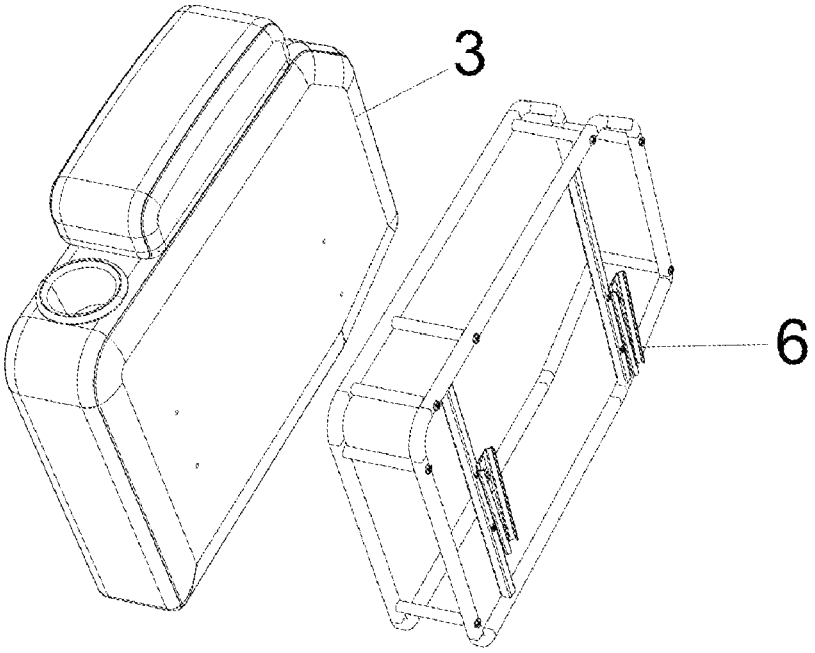
FIG. 6 is a schematic diagram of the armrest structure of the detachable sofa of the invention disclosure.

As shown in FIGS. 4-6, the armrest frames 32 on both sides of the armrest 3, the body of the backrest 1 and the left and right side wings 12 and 13 are all composed of support frames and the flexible packaging materials covering on them. The left side of the FIGS. 4-6 show the outer flexible packaging materials, the right side of the FIGS. 4-6 show the inner support frames. The first locking slots 5 and the second locking slots 6 are threadedly fixed to these support frames passing through external flexible packaging materials. The above-mentioned support frames are threadedly connected by a plurality of tubular members (e.g. steel pipes) and/or plate-shaped parts. Therefore, the disassembly and assembly of the armrest frame 32 of the armrest 3, the body of the backrest 1 and the left and right side wings 12 and 13 are very convenient.

In the detachable sofa of the invention disclosure, the backrest and the armrest can be further disassembled into smaller component modules, which can occupy smaller space and volume during storage and transportation, thus greatly reduce storage and transportation costs.

However, those of ordinary skill in the art should realize that the above embodiments are only used to illustrate the invention disclosure, not to limit it. Changes and modifications of the embodiments will fall within the scope of the claims of the invention disclosure.

I claim:

1. A detachable sofa, comprising:

a backrest;

a seat;

two armrests; and a chassis, wherein the backrest comprises a backrest body, left and right side wings, and the left and right side wings are detachably connected to the backrest body; each armrest includes an armrest pad and an armrest frame, and each armrest is detachably connected to the seat.

2. The detachable sofa according to claim 1, wherein the backrest body and the left and right side wings are connected by locking slots, and the armrests and the seat are connected by locking slots.

3. The detachable sofa according to claim 2, wherein two sides of the backrest body and two sides of the seat are provided with first locking slots, the left and right side wings and the left and right armrests are all provided with second locking slots, the cross-section of the locking slots is basically U-shaped, the width of the locking slots gradually increases from one end to the other end, and the width of the first locking slots are generally slightly larger than that of the second locking slot.

4. The detachable sofa according to claim 3, wherein the maximum width of the second locking slots is greater than the minimum width of the first locking slots.

5. The detachable sofa according to claim 4, wherein the armrest frames of the armrests, the backrest body and the left and right side wings are all composed of support frames and flexible packaging materials covering the support frames.

6. The detachable sofa according to claim 3, wherein the first locking slots and the second locking slots are threadedly connected to the support frames.

* * * * *